US007960452B2

(12) United States Patent
Khabbaz et al.

(10) Patent No.: US 7,960,452 B2
(45) Date of Patent: Jun. 14, 2011

(54) ADHESIVE COMPOSITION AND METHOD

(75) Inventors: Farideh Khabbaz, Bromma (SE); Anders Per Eriksson, Nacka (SE); Joanna Fare, Huddinge (SE); Anna Kristina Furberg, Sundbyberg (SE)

(73) Assignee: Akzo Nobel Coatings International B.V., Arnhem (NL)

( * ) Notice: Subject to any disclaimer, the term of this patent is extended or adjusted under 35 U.S.C. 154(b) by 169 days.

(21) Appl. No.: 11/473,964

(22) Filed: Jun. 23, 2006

(65) Prior Publication Data

US 2007/0004829 A1 Jan. 4, 2007

Related U.S. Application Data

(60) Provisional application No. 60/695,445, filed on Jul. 1, 2005.

(51) Int. Cl.

| | |
|---|---|
| ***B29C 47/00*** | (2006.01) |
| ***C08L 3/00*** | (2006.01) |
| ***C08L 89/00*** | (2006.01) |
| ***D21H 19/54*** | (2006.01) |
| ***C08F 16/06*** | (2006.01) |
| ***C08F 116/06*** | (2006.01) |
| ***C08F 216/06*** | (2006.01) |
| ***C08G 63/48*** | (2006.01) |
| ***C08G 63/91*** | (2006.01) |

(52) U.S. Cl. ..... 524/13; 524/47; 525/54.26

(58) Field of Classification Search ..... 524/47, 524/13; 525/54.26

See application file for complete search history.

(56) References Cited

U.S. PATENT DOCUMENTS

| | | | | | |
|---|---|---|---|---|---|
| 2,051,025 | A | | 8/1936 | Bauer | 154/33 |
| 2,102,937 | A | | 12/1937 | Bauer | 134/23.4 |
| 2,250,681 | A | | 7/1941 | Schwartz | 260/9 |
| 2,282,364 | A | | 5/1942 | Kunze et al. | 106/210 |
| 3,345,198 | A | * | 10/1967 | Winkler et al. | 427/288 |
| 3,355,307 | A | | 11/1967 | Schoenberger et al. | 106/213 |
| 3,361,585 | A | | 1/1968 | Armour et al. | |
| 3,467,608 | A | | 9/1969 | Dishburger et al. | |
| 3,487,033 | A | | 12/1969 | McElmury et al. | 260/17.3 |
| 3,941,728 | A | * | 3/1976 | Solenberger | 524/557 |
| 3,944,428 | A | | 3/1976 | Schoenberg et al. | 106/213 |
| 4,018,959 | A | * | 4/1977 | Demko et al. | 428/182 |
| 4,183,997 | A | | 1/1980 | Stofko | 428/326 |
| 4,350,788 | A | | 9/1982 | Shimokawa et al. | |
| 4,687,809 | A | | 8/1987 | Kamikaseda et al. | |
| 4,910,048 | A | | 3/1990 | Sinclair | 427/208.6 |
| 5,000,783 | A | * | 3/1991 | Dingeman et al. | 75/321 |
| 5,112,391 | A | * | 5/1992 | Owen et al. | 75/772 |
| 5,185,212 | A | * | 2/1993 | Spada et al. | 428/483 |
| 5,190,996 | A | | 3/1993 | Foran et al. | 524/28 |
| 5,247,066 | A | | 9/1993 | Schoenberg et al. | 528/491 |
| 5,283,277 | A | * | 2/1994 | Kissel | 524/211 |
| 5,384,187 | A | * | 1/1995 | Uemura et al. | 442/59 |
| 5,498,224 | A | * | 3/1996 | Kauffman et al. | 493/39 |
| 5,627,261 | A | | 5/1997 | Albrecht et al. | 528/492 |
| 5,684,075 | A | * | 11/1997 | Patel et al. | 524/386 |
| 5,804,618 | A | * | 9/1998 | Mafoti et al. | 524/53 |
| 5,849,405 | A | * | 12/1998 | Wang et al. | 428/304.4 |
| 5,858,554 | A | * | 1/1999 | Neal et al. | 428/537.5 |
| 5,889,107 | A | * | 3/1999 | Jakob et al. | 524/783 |
| 6,207,176 | B1 | | 3/2001 | Howard et al. | 424/402 |
| 6,255,369 | B1 | | 7/2001 | Philbin et al. | 524/47 |
| 6,440,204 | B1 | | 8/2002 | Rogols et al. | 106/134.1 |
| 6,562,325 | B2 | | 5/2003 | Vitale et al. | |
| 6,566,472 | B1 | * | 5/2003 | Baumstark et al. | 526/263 |
| 6,706,145 | B2 | | 3/2004 | Werres et al. | |
| 6,710,175 | B2 | * | 3/2004 | Anderson et al. | 536/45 |
| 6,746,542 | B1 | | 6/2004 | Lorencak et al. | 127/32 |
| 6,753,361 | B2 | * | 6/2004 | Kroner et al. | 524/14 |
| 6,803,420 | B2 | * | 10/2004 | Cleary et al. | 525/205 |
| 6,956,070 | B2 | * | 10/2005 | Fujiwara et al. | 524/47 |
| 7,034,068 | B1 | * | 4/2006 | Negele et al. | 524/45 |
| 7,074,845 | B2 | * | 7/2006 | Laleg | 524/47 |
| 7,235,608 | B2 | | 6/2007 | Hu et al. | |
| 2002/0015823 | A1 | * | 2/2002 | Mauler et al. | 428/156 |
| 2002/0096288 | A1 | * | 7/2002 | Allen | 162/168.1 |
| 2003/0102097 | A1 | * | 6/2003 | Moffett | 162/168.3 |
| 2003/0116294 | A1 | | 6/2003 | Kehrer et al. | |
| 2003/0119949 | A1 | * | 6/2003 | Favis et al. | 524/47 |
| 2003/0155071 | A1 | | 8/2003 | Werres et al. | 156/307.3 |
| 2004/0014844 | A1 | * | 1/2004 | Helbling et al. | 524/47 |
| 2004/0018332 | A1 | | 1/2004 | Hu et al. | 428/60 |
| 2004/0143038 | A1 | * | 7/2004 | Aberle | 524/27 |
| 2004/0254285 | A1 | * | 12/2004 | Rodrigues et al. | 524/494 |
| 2005/0022956 | A1 | * | 2/2005 | Rodriguez et al. | 162/135 |
| 2005/0150621 | A1 | * | 7/2005 | Neivandt et al. | 162/175 |

(Continued)

FOREIGN PATENT DOCUMENTS

| | | |
|---|---|---|
| CL | 1710-2006 | 6/2006 |

(Continued)

OTHER PUBLICATIONS

Matuana et al., Wood Composites, 2004, Enc. of Poly. Sci. and Tech., John Wiley and Sons.*

(Continued)

*Primary Examiner* — Mark Eashoo
*Assistant Examiner* — Liam J Heincer
(74) *Attorney, Agent, or Firm* — Kenyon & Kenyon LLP

(57) ABSTRACT

The invention relates to an adhesive composition comprising at least partly gelatinized starch and one or more polymers (P) containing an amine group or an amide group. It also relates to a method of gluing pieces of wood based materials and to a wood based product.

23 Claims, No Drawings

U.S. PATENT DOCUMENTS

| | | | | |
|---|---|---|---|---|
| 2005/0197441 | A1 | 9/2005 | Shibutani et al. | |
| 2006/0128840 | A1 | 6/2006 | Graux et al. | |
| 2006/0183822 | A1* | 8/2006 | Nguyen-Kim et al. | 524/35 |
| 2007/0004828 | A1 | 1/2007 | Khabbaz | |
| 2007/0270608 | A1* | 11/2007 | Boersma et al. | 562/400 |
| 2007/0298274 | A1* | 12/2007 | Eriksson et al. | 428/541 |
| 2009/0317651 | A1 | 12/2009 | Khabbaz | |

FOREIGN PATENT DOCUMENTS

| | | | |
|---|---|---|---|
| CL | 1711-2006 | | 6/2006 |
| CN | 1033525 | | 6/1989 |
| CN | 1742055 | | 3/2006 |
| DE | 43 08 089 | | 9/1994 |
| EP | 0 001 501 | | 4/1979 |
| EP | 0 001 501 | B1 | 4/1979 |
| EP | 0 229 741 | | 7/1987 |
| EP | 0 229 741 | B1 | 7/1987 |
| EP | 0 948 959 | | 10/1999 |
| EP | 0 948 959 | A2 | 10/1999 |
| EP | 0 948 959 | A3 | 10/1999 |
| EP | 1 486 547 | | 12/2004 |
| EP | 1 486 547 | A2 | 12/2004 |
| EP | 1 486 547 | A3 | 12/2004 |
| GB | 1 456 629 | | 11/1976 |
| GB | 2 084 588 | A | 4/1982 |
| GB | 2084588 | | 4/1982 |
| JP | 60-53578 | | 3/1985 |
| JP | 61021171 | A * | 1/1986 |
| JP | 6-299136 | | 10/1994 |
| JP | 2004-35580 | | 2/2004 |
| RU | 2172749 | | 9/2000 |
| WO | WO 97/37842 | | 10/1997 |
| WO | WO 01/85441 | | 11/2001 |
| WO | WO 01/85441 | A1 | 11/2001 |
| WO | WO 02/088468 | | 11/2002 |
| WO | WO 03/069061 | A1 | 8/2003 |
| WO | WO 03/087473 | | 10/2003 |
| WO | WO 03/102065 | | 12/2003 |
| WO | WO 2004029147 | A1 * | 4/2004 |
| WO | WO 2005/113700 | | 12/2005 |
| WO | WO 2007/004978 | | 1/2007 |
| WO | WO 2007/004980 | | 1/2007 |
| WO | WO 2007/149037 | | 12/2007 |

OTHER PUBLICATIONS

Bastioli (Starch, Encyclopedia of Polymer Science and Technology, 2004).*

European Search Report for Application No. EP 05 10 6006 dated Oct. 5, 2005.

Derwent Abstract No. 0004095866 abstracting EP 0 229 741 B1.

Imam, S. H. et al., "Wood Adhesive from Crosslinked Poly(vinyl Alcohol) and Partially Gelatinized Starch: Preparation and Properties," Starch/Starke 51, No. 6 (1999) pp. 225-229.

A.M. Prokhorov, *Great Soviet Encyclopedia*, v. 23, 1976, p. 463-464. (English-language summary of "System" is included as provided by the foreign associate).

A. Mori et al., "A Honeymoon-Type Adhesive for Wood Products Based on Acetoacetylated Poly(vinyl alcohol) and Diamines: Effect of Diamines and Degree of Acetacetylation", *Journal of Applied Polymer Science*, vol. 91, pp. 2966-2979, (2004).

English-language Abstract of Russian document by Ushakov D.N. 2006.

International Search Report and Written Opinion, International PCT Application No. PCT/SE2007/050405, mailed Sep. 26, 2007.

International Preliminary Report on Patentability, International PCT Application No. PCT/SE2007/050405, mailed Sep. 30, 2008.

* cited by examiner

ADHESIVE COMPOSITION AND METHOD

This application claims priority based on U.S. Provisional Patent Application No. 60/695,445, filed Jul. 1, 2005.

The present invention relates to an adhesive composition, a method of manufacturing an adhesive composition, a method of gluing wood based materials and to a wood based product.

INTRODUCTION

Formaldehyde based resins are widely used in adhesive compositions used for gluing wood based materials. Examples are multilayered products comprising a number of veneers glued together to form products used in the manufacture of, e.g., furniture, or to form plywood. In the furniture industry there is also common to glue a veneer onto a particle- or fibre board. Also flooring materials usually comprise several glue lines joining layers of wood based materials. Upon curing a formaldehyde based resin, formaldehyde may be released both during the manufacture of the product and also afterwards during use of the product. Formaldehyde present in indoor air is a major concern since many years for health reasons.

There is an increasing demand for glued wood based products such as furniture materials, flooring materials and other indoor building materials which meet the more severe emission standards coming into force.

As an alternative to adhesive compositions comprising formaldehyde based resins adhesives based on polymer dispersions of e.g. polyvinyl acetate is available. However, when making compression-moulded products by glueing together layers of veneers and pressing the structure into a certain shape it is important to minimise the so called "spring back" of the glued structure when it is released from the mould. Polyvinyl acetate based adhesives generally give bad results in terms of spring back.

It is also important that a compression-moulded product substantially keeps its shape during use, i.e., when subjected to a load. This property can be measured by a so called "fatigue test", used in e.g. for furniture products, where a compression-moulded product is subjected to a large number of cycles of a load.

As an alternative to formaldehyde based resins in wood adhesive compositions also starch based adhesives have been proposed. Imam et al., "Wood Adhesive from Crosslinked Poly(vinyl alcohol) and Partially Gelatinized Starch: Preparation and Properties", Starch/Stärke 51 (1999) Nr. 6, S. 225-229, discloses an adhesive composition comprising starch and polyvinyl alcohol, the composition further comprising a melamine resin. The pressing temperature needed is very high. U.S. Pat. Nos. 2,051,025, 2,102,937, 3,487,033, 3,355,307 disclose starch based adhesives used for making corrugated paperboard. WO 03/069061 A1 discloses a starch based adhesive used in making a paperboard product.

However, a general problem encountered with prior art starch based adhesive compositions is the viscosity increase already at moderate dry contents. A too high viscosity makes spreading of an adhesive composition difficult. A sufficient dry content is generally needed to obtain good gluing properties such as glue strength and no spring back at compression moulding. Thus, a major issue is how to increase the dry content and still be able to handle and use the adhesive in a good way.

Also, partially gelatinised starch contains particles or granules of starch which are partly or completely un-gelatinised which may settle during storage. Thus, the storage stability is often bad.

Thus, technical solutions are still needed for how to further improve starch based adhesive compositions in order to make them more suitable for gluing wood based materials.

Accordingly, the present invention provides an adhesive composition which is based on starch in which the dry content can be high while still having a comparatively low viscosity and which gives excellent gluing quality and good storage stability. Also, a method of gluing wood based materials is provided and a wood based product. The wood based products made according to the invention suitably show good results in, e.g., bond strength, water resistance, low spring back and shape-retention during load for compression moulded veneers (fatigue test).

By "solids content" of an adhesive composition is herein meant the non-water part of the adhesive composition.

THE INVENTION

The adhesive composition, according to the invention, comprises at least partly gelatinised starch and one or more polymers (P) containing an amine group or an amide group.

The invention further relates to a method of manufacturing an adhesive composition comprising mixing starch and one or more polymers (P) containing an amine group or an amide group in an aqueous phase at an elevated temperature to at least partly gelatinise the starch. Suitably, starch is added to an aqueous composition comprising the one or more polymers (P). The temperature may be elevated in the aqueous composition before starch is added. Alternatively, the temperature is elevated after starch has been added.

The invention further relates to an adhesive composition obtainable by the method of manufacturing an adhesive composition.

The invention further relates to a wood based product comprising pieces of wood based material joined with an adhesive comprising starch and one or more polymers (P) containing an amide group or an amide group.

The required temperature for at least partly gelatinise the starch depends on the type of starch used, but is generally at least 50° C. The at least partly gelatinised starch is obtainable by subjecting an aqueous mixture comprising starch to an elevated temperature of suitably from about 50 to about 99° C., preferably from about 50 to about 80° C., most preferably from about 55 to about 70° C. The at least partly gelatinised starch is obtainable by maintaining the aqueous mixture comprising starch to the elevated temperature for suitably at least about 0.1 minutes, also suitably from about 0.1 to about 180 minutes, preferably at least 1 minute, also preferably from about 1 to about 60 minutes, most preferably at least 10 minutes, also most preferably from about 10 to about 40 minutes.

In one embodiment of the invention, embodiment A, the starch is partly gelatinised to a less degree and is obtainable by subjecting an aqueous mixture comprising starch to an elevated temperature of preferably from about 50 to about 70° C., most preferably from about 55 to about 65° C. In this case, the partly gelatinised starch is obtainable by maintaining the aqueous mixture comprising starch to the elevated temperature for preferably at least 1 minute, also preferably from about 1 to about 40 minutes, most preferably at least 5 minutes, also most preferably from about 5 to about 30 minutes.

In another embodiment of the invention, embodiment B, the starch is partly gelatinised to a higher degree, or completely gelatinised, and is obtainable by subjecting an aqueous mixture comprising starch to an elevated temperature of preferably from about 70 to about 99° C., most preferably from about 80 to about 95° C. In this case, the partly gelatinised starch is obtainable by maintaining the aqueous mixture comprising starch to the elevated temperature for preferably at least 1 minute, also preferably from about 1 to about 240 minutes, most preferably at least 10 minutes, also most preferably from about 10 to about 100 minutes.

The amount of starch in the adhesive composition is suitably from about 1 to about 50 weight %, preferably from about 15 to about 40 weight %, more preferably from about 20 to about 40 weight %, most preferably from about 30 to about 40 weight %, alternatively most preferably from about 20 to about 35 weight %.

The amount of the one or more polymers (P) in the adhesive composition, is suitably from about 0.1 to about 50 weight %, preferably from about 1 to about 40 weight %, more preferably from about 2 to about 25 weight %, most preferably from about 2 to about 15 weight %.

The amount of the sum of starch and the one or more polymers (P) in the adhesive composition is suitably from about 20 to about 70 weight %, preferably from about 35 to about 60 weight %.

The solids content in the adhesive composition is suitably from about 20 to about 70 weight %, preferably from about 35 to about 60 weight %, more preferably from about 40 to about 50 weight %, most preferably from about 42 to about 50 weight %.

Examples of suitable starches are native starches and modified starches made from, e.g., potato, corn, wheat, rice, peas etc., such as: acetylated degraded starch, alkyl succinic acid modified starch, oxidated starch, hydroxypropylated starch, cationic starch, amylopectin starch, high amylose acetylated starch, tapioka starch, native potato starch, native corn starch, native wheat starch, native rice starch, and, native pea starch.

The one or more polymers (P) suitably comprise monomer units containing an amine or an amide group. Suitably, from about 5 to about 100% of the monomer units in the one or more polymers (P) contain an amine or an amide group, preferably from about 25 to about 100%, more preferably from about 50 to about 100%, even more preferably from about 90 to about 100%. Most preferably all of the monomer units in the one or more polymers (P) contain an amine or an amide group. The one or more polymers (P) suitably contain a primary amine group or an amide group. The one or more polymers (P) preferably comprise one or more of polyvinyl amine, poly(vinylalcohol-co-vinyl amine), poly(vinylalcohol-co-vinylformamide), polyallylamine, polyethylene imine, polyamidoamine and polyvinyl formamide. More preferably the one or more polymers (P) comprise one or more of polyvinyl amine, polyethylene imine and poly(vinylalcohol-co-vinylamine). Most preferably polymer (P) is polyvinyl amine.

Polyvinyl amine is usually made by hydrolysing polyvinyl formamide to a certain degree. By "polyvinyl amine" is herein meant a polyvinyl amine wherein the mole ratio of amine groups to formamide groups is from 5:95 to 100:0. If the mole ratio of amine groups to formamide groups is less than 5:95 the polymer is defined as a polyvinyl formamide. The mole ratio of amine groups to formamide groups in the polyvinyl amine is preferably from about 10:90 to about 100:0, more preferably from about 50:50 to about 100:0, most preferably from about 80:20 to about 100:0.

Poly(vinyl alcoho-co-vinyl amine) is usually made by copolymerising vinyl acetate and vinyl formamide followed by hydrolysis which gives a co-polymer having vinyl alcohol and vinyl amine units. There may also be remaining formamide groups in the co-polymer and also remaining acetate groups. The mole ratio of amine groups to formamide groups in the poly(vinyl alcohol-co-vinyl amine) is from 5:95 to 100:0. If the number ratio of amine groups to formamide groups is less than 5:95 the polymer is defined as a poly(vinyl alcohol-co-vinyl formamide). The mole ratio of hydroxyl groups to acetate groups in the poly(vinyl alcoho-co-vinyl amine) or poly(vinyl alcohol-co-vinyl amide) is suitably from about 25:75 to 100:0, preferably from about 75:25 to 100:0. The mole ratio of amine and formamide groups to hydroxyl and acetate groups in the poly(vinyl alcoho-co-vinyl formamine) or poly(vinyl alcohol-co-vinyl formamide) is suitably from about 3:97 to about 100:0, preferably from about 10:90 to about 100:0, most preferably from about 25:75 to about 100:0.

The one or more polymers (P) have suitably a weight average molecular weight of from about 1,000 to about 1,000,000 g/mol, preferably from about 10,000 to about 800,000 g/mol, more preferably from about 20,000 to about 600,000 g/mol, most preferably from about 50,000 to about 500,000 g/mol.

In embodiment A of the invention, the viscosity (Brookfield, 12 rpm, spindle 4, at 20° C.) of the adhesive composition is suitably lower than 100,000 mPa*s, preferably from about 5,000 to about 50,000 mpa*s, most preferably from about 10,000 to about 25,000 mPa*s.

The adhesive composition may further comprise additives such as viscosity adjusting agents and fillers such as kaolin, wheat meal, soy meal, walnut shell meal, or other known to be suitable for use in wood adhesive formulations.

The adhesive composition may also comprise inorganic-or organic salts which may have originated from a solution of the one or more polymers (P) used when making the starch based adhesive composition. A part of the one or more polymers (P) may be tonically charged, preferably cationically charged. The amount of negative counter-ions of the salts in the adhesive composition can be from 0 to about 10 weight %, or from about 0.1 to about 5 weight %, or from about 0.2 to about 1 weight %.

The starch based adhesive composition may also be combined with a further composition, suitably an adhesive composition, based on a dispersion of a polymer or copolymer of one or more ethylenically unsaturated monomers, which does suitably not comprise any amine or amide groups. In this case, the amount of starch based adhesive is suitably from about 10 to about 99 weight %, preferably from about 25 to about 85 weight %, also preferably from about 25 to about 75 weight %, most preferably from about 50 to about 75 weight %, based on the total of wet adhesive. This further adhesive composition may, besides being mixed-in with the starch based adhesive, also be used as a separate component in combination with the starch based adhesive composition.

In a further embodiment, the starch based adhesive composition may comprise a polymer or copolymer of one or more ethylenically unsaturated monomers, which does suitably not comprise any amine or amide groups.

Examples of suitable polymers or copolymers of one or more ethylenically unsaturated monomers are vinyl ester homopolymers such as polyvinyl acetate, copolymers of vinylesters such as ethylene-vinyl acetate copolymer (EVA) or copolymers of vinylacetate with acrylic monomers such as methylmethacrylate or butylacrylate, styrene-butadiene rubber (SBR), and polyacrylates.

Generally, the inclusion of polymers or copolymers of one or more ethylenically unsaturated monomers, of the types listed above, in the starch based adhesive composition, or in combination with the starch based adhesive composition, may improve the bonding characteristics, such as fiber tear of a veneered or laminated product.

The adhesive composition may also be combined with a cross-linker shortly before use. Suitable cross-linkers are those which are reactive to amino and/or hydroxyl groups. Examples of crosslinkers are: isocyanates, monomers or polymers containing acetoacetoxy groups, adipic acid, melamine formaldehyde resin, urea formaldehyde resin, melamine salts, aldehydes such as glutaraldehyde, glyoxal, and polymeric aldehydes such as dialdehyde starches, and, complexing agents such a zirconium salts. Preferably polymers containing acetoacetoxy groups are used as cross-linker such as acetoacetylated polyvinyl alcohol. If used, the amount of the cross-linker in the adhesive composition is suitably up to about 30 weight %, or from about 0.1 to about 30 weight %, preferably from about 0.1 to about 10 weight %, most preferably from about 0.5 to about 5 weight %.

The invention further relates to the use of the adhesive composition according to the invention for gluing pieces of wood based materials forming a wood based product.

The invention further relates to a method of gluing pieces of wood based materials comprising applying the adhesive composition according to the present invention onto one or more pieces of a wood based material, and joining the one or more pieces with one or more further pieces of a material, preferably wood based material.

In one embodiment, the method suitably comprises applying the adhesive composition according to the present invention onto a piece of wood based material, contacting the surface with applied adhesive composition with a surface of another piece of wood based material, thereby joining the pieces through the formation of an adhesive joint between the pieces.

By wood-based materials is herein, beside solid wood, also included wooden materials such as fibre-, chip-, and particleboard materials. The surfaces to be joined may be of the same or different type of wood based material.

The wood based material can be any type and form of wood based material such as chips, fibres, sheets, laminas, veneers, pieces etc.

In one embodiment, when manufacturing laminated products, the method suitably comprises application of the adhesive composition according to the invention onto a surface so that the glue joint will comprise an originally applied amount of from about 0.1 to about 500 g/m$^2$. The applied amount depends on the product to be produced: for compression moulded veneers it is preferably from about 50 to about 200 g/m$^2$, for laminated flooring material it is preferably from about 100 to about 160 g/m$^2$, and for laminated beams it is preferably from about 180 to about 500 g/m$^2$. The suitable upper limit also depends on which type of wood based material that is applied with the solution. The adhesive composition may be applied on one or both of the surfaces to be joined. If applied on both surfaces, the sum of the amounts applied on each surface will correspond to the preferred amounts for the whole glue joint specified.

When making compression-moulded veneers, the method suitably comprises the joining of more than two pieces of wood based materials, preferably from 2 to 15.

In one embodiment, the method comprises gluing pieces of wood based materials wherein the pieces of wood based material are wood chips, in which the term "wood chips" herein includes chips, shavings, flakes, sawdust particles and any similar finely divided wood based material. In this case the wood based product is a composite product such as a chip-, particle-or fibre board, or an oriented strand board.

The moisture content of the wood chips to be used is suitably from about 0 to about 20 weight %, preferably from about 1 to about 10 weight %, more preferably from about 1.5 to about 5 weight %.

The weight ratio wood chips to adhesive composition, calculated as dry weight, is suitably from about 100:1 to about 1:1, preferably from about 50:1 to about 2:1, more preferably from about 30:1 to about 2.5:1, most preferably from about 15:1 to about 3:1.

The moisture content of the mixture of wood chips and adhesive composition at the beginning of the pressing is suitably from about 3 to about 25 weight %, preferably from about 5 to about 20 weight %, most preferably from about 7 to about 15 weight %.

The application of the adhesive composition is preferably followed by pressing. The pressing suitably takes place at an elevated temperature. The pressing temperature depends on which wood based product intended to be manufactured but can suitably be from about 0 to about 250° C. and preferably from about 70 to about 200° C.

For laminated or veneered products, the pressing temperature, when no cross-linker has been added to the adhesive composition, is suitably from about 0° C. to about 200° C., preferably from about 20 to about 150° C., even more preferably from about 50 to about 130° C., most preferably from about 70 to about 130° C. When a cross-linker has been added to the adhesive composition, the pressing temperature may sometimes be decreased depending on the efficiency of the cross-linker.

For particle-, chip-, and fibreboard products, the pressing temperature is preferably from about 100 to about 225° C., most preferably from about 150 to about 200° C. For laminated products, such as plywood, laminated flooring or veneered flooring products, the pressing temperature is preferably from about 70 to about 175° C., most preferably from about 90 to about 160° C.

The pressing time and pressing temperature are linked so that lower pressing temperatures generally require longer pressing times. The wood based product to be produced does also determine suitable pressing temperatures and pressing times. The pressing time is suitably at least about 10 s, also suitably from about 10 s to about 60 minutes, preferably at least about 30 s, also preferably from about 30 s to about 30 minutes, most preferably at least about 1 minute, also preferably from about 1 to about 15 minutes.

In one embodiment of the method the adhesive composition is dried after application and later remoistened by adding water or an aqueous solution before contacting the surface having the adhesive composition applied with another surface. The aqueous solution may comprise a polymer comprising amine or amide groups, of a kind as already described hereinbefore, or a cross-linker which is suitably reactive to amino and/or hydroxyl groups.

In one embodiment of the method, preferably when producing the wood based material is in the form of wood chips, the piece or pieces of wood based material is first contacted with an aqueous solution comprising a cross-linker. Suitable cross-linkers are those which are reactive to amino and/or hydroxyl groups.

Examples of cross-linkers in the two above-described embodiments are: isocyanates, monomers or polymers containing acetoacetoxy groups, adipic acid, melamine formaldehyde resin, urea formaldehyde resin, melamine salts, aldehydes such as glutaraldehyde, glyoxal, and polymeric aldehydes such as dialdehyde starches, and, complexing agents such a zirconium salts. Preferably polymers containing acetoacetoxy groups are used as cross-linker such as acetoacetylated polyvinyl alcohol.

The present invention also relates to a wood based product obtainable by the method of gluing pieces of wood based materials.

In one embodiment, the wood based product of the invention comprises one or more layers, joined with one or more adhesive joints comprising starch and one or more polymers (P) containing an amide group or an amide group.

The wood based product of the invention can be a flooring material, a veneered furniture material, plywood, a wall panel, a roofing panel, a laminated beam, or a composite product such as a particle board, fibre board, chip board, oriented strand board. The wood based product of the invention is preferably plywood, a veneered furniture material, veneered flooring, laminated flooring or a particle board.

In one embodiment, the wood based product of the invention comprises a composite product comprising wood based chips joined together with an adhesive comprising starch and one or more polymers (P) containing an amide group or an amide group. The composite product suitably comprises from about 70 to about 98 weight %, preferably from about 80 to about 90 weight %, of wood based material, from about 2 to about 25 weight %, preferably from about 5 to about 15 weight %, of starch, and from about 0.5 to about 10 weight %, preferably from about 2 to about 6 weight % of the one or more polymers (P), the amounts calculated as dry weight of the composite product.

The composite product is preferably a chip-, particle-or fibre board, or an oriented strand board.

The amount of starch in the one or more dry adhesive joints in the finished wood based product is suitably from about 10 to about 75 weight %, preferably from about 25 to about 65 weight %, most preferably from about 40 to about 60 weight %.

The amount of the one or more polymers (P) in the one or more dry adhesive joints in the finished wood based product is suitably from about 25 to about 90 weight %, preferably from about 35 to about 75 weight %, most preferably from about 40 to about 60 weight %.

The invention is further illustrated by means of the following non-limiting examples. Parts and percentages relate to parts by weight respectively percent by weight, unless otherwise stated.

EXAMPLES

Example 1

A starch based adhesive was made by mixing 66 g of an aqueous solution of about 7.5 weight % polyvinyl amine (Lupamin® 9095 from BASF), 5 g water and 37.5 g corn starch (C*Gum NC 03432 from Cerestar, 10% moisture content). The starch was partly gelatinised by stirring the mixture at 63° C. for 20 minutes. The number ratio of amine groups to formamide groups in the polyvinyl amine was more than 90:10. The weight average molecular weight of the polyvinyl amine was 340,000 g/mol. The dry content of the adhesive was measured to 45 weight %. The viscosity of the composition was measured to 15,000 mpa*s at 20° C. (Brookfield, 12 rpm, spindle 4).

Example 2

A starch based adhesive was made by mixing 66 g of an aqueous solution of 17 weight % polyvinyl formamide (Lupamin® 9000 from BASF), 5 g water and 37.5 g corn starch (C*Gum NC 03432 from Cerestar, 10% moisture content). The starch was partly gelatinised by stirring the mixture at 63° C. for 20 minutes. The number ratio of amine groups to formamide groups in the polyvinyl formamide was 0:100. The weight average molecular weight of the polyvinyl formamide was 340,000 g/mol. The dry content of the adhesive was measured to 41 weight %. The viscosity of the composition was measured to 65,000 mPa*s at 20° C. (Brookfield, 12 rpm, spindle 4).

Example 3

A starch based adhesive was made by mixing 66 g of an aqueous solution of 17 weight % poly(vinyl alcohol-co-vinyl amine) (custom-made from Erkol), 5 g water and 37.5 g corn starch (C*Gum NC 03432 from Cerestar, 10% moisture content). The starch was partly gelatinised by stirring the mixture at 63° C. for 20 minutes. The poly(vinyl alcohol vinyl amine) had a degree of hydrolysis of 99% of the acetate groups. The mole ratio amine and formamide groups to hydroxyl and acetate groups in the poly(vinyl alcohol-co-vinyl amine) or poly(vinyl alcohol-co-vinyl amide) being around 10:90. The weight average molecular weight of the polymer being about 30,000 and 50,000 g/mol. The dry content of the adhesive was measured to 42 weight %. The viscosity of the composition was measured to 42,500 mpa*s at 20° C. (Brookfield, 12 rpm, spindle 4).

Example 4

A starch based adhesive was made by mixing 66 g of an aqueous solution of 17 weight % polyvinyl alcohol (Kuraray Poval® 217 from Kuraray), 5 g water and 37.5 g corn starch (C*Gum NC 03432 from Cerestar, 10% moisture content). The starch was partly gelatinised by stirring the mixture at 63° C. for 20 minutes. The polyvinyl alcohol had a degree of hydrolysis of 87-89%. The dry content of the adhesive was measured to 42 weight %. The viscosity of the composition was measured to 141,000 mPa*s at 20° C. (Brookfield, 12 rpm, spindle 4).

It is concluded from Examples 1-4 that the viscosity of the starch based adhesive is significant lower when a polymer according to the invention (Examples 1-3) is used instead of polyvinyl alcohol.

Example 5

An adhesive composition as in Example 1 was mixed with a polyvinyl acetate adhesive (Mowilith® DHSS3 from Celanese) in the ratio 50:50. The polyvinyl acetate adhesive had a dry content of 50 weight %. The mixed adhesive was tested by gluing together 13 veneers of beech with an applied adhesive amount of 150 g/m$^2$, and compression moulding the assembly with a pressing time of 10 minutes and at a pressing temperature of 90° C. The result was no spring back, good strength and 60-70% (good) fiber tear.

Example 6

A polyvinyl acetate adhesive, the same as used in Example 5 was tested on its own by gluing together 13 veneers of beech in the same way as in Example 5. The result was good strength and 60% (good) fiber tear, but significant spring back.

Example 7

An adhesive composition as in Example 1 was made with the difference that the gelatinisation was performed at 90° C.

for 60 minutes. The result was a soft, spreadable pastelike composition. When making a compression moulded product as in Example 5 the result was no spring back, good strength and 60-80% (good) fiber tear.

Example 8

A starch based adhesive according to Example 1 was applied onto a 15×15 cm particle board in an amount of 130 g/m$^2$. A veneer of beech (0.6 mm) was then pressed onto the board. The assembly was pressed during 1 minute at 130° C. The gluing strength measured as fiber tear (chisel) was measured on a warm assembly (directly after pressing) and on a cold assembly, respectively, after pressing.

The fiber tear (warm) was 100% and the fiber tear (cold) was also 100%.

Example 9

A starch based adhesive according to Example 1 was applied onto a 15×15 cm particle board in an amount of 130 g/m$^2$. A veneer of beech (0.6 mm) was then pressed onto the board. The assembly was pressed during 10 minutes at 90° C. The gluing strength measured as fiber tear (chisel) was measured on a warm assembly (directly after pressing) and on a cold assembly, respectively, after pressing. The same procedure was repeated but using an adhesive according to Example 1 to which an aqueous solution comprising 17 weight % acetoacetylated polyvinyl alcohol (MPVA) had been added in an amount of 10 parts per 100 parts of the adhesive composition according to Example 1. The results are given in Table 1.

TABLE 1

| | Fiber tear, warm (%) | Fiber tear, cold (%) |
|---|---|---|
| starch + polyvinylamine | 0 | 10-20 |
| starch + polyvinylamine + AAPVA | 60-70 | 100 |

It is concluded that the addition of a cross-linker (MPVA) increases the bonding strength.

Example 10

A particle board was manufactured by mixing 864 g wood chips, having a moisture content of 2 weight %, with 285 g of an adhesive composition made according to Example 1. The chips mixture was formed into a sheet of 30×30 cm and pressed at 185° C. for three minutes into a board of 16 mm thickness. The sequence of pressure was 160 kg/cm$^2$ during 30 s, 40 kg/cm$^2$ during 2.5 min and no pressure during the last 30 s. The tensile strength (internal bond, IB) was measured by gluing pieces of 5×5 cm onto two metal blocks and tearing them apart. Thickness swelling (TSW) and water absorption (ABS) were also measured. Thickness swelling was measured by determining the degree of swelling after a piece of 5×5 cm had been immersed in water (20° C., 24 hrs). Water absorption was measured by determining the weight increase after a piece of 5×5 cm had been immersed in water (20° C., 24 hrs).

The IB value was 750 kPa, TSW 33.2% and ABS (24 h) was 97.1%.

Example 11

A particle board was manufactured by first mixing 864 g wood chips, having a moisture content of 2 weight %, with 28 g of an aqueous solution comprising 11 weight % of acetoacetylated polyvinyl alcohol (AAPVA) and thereafter mixing in 285 g of an adhesive composition made according to Example 1. The chips mixture was formed into a sheet of 30×30 cm and pressed at 185° C. for three minutes into a board of 16 mm thickness. The sequence of pressure was 160 kg/cm$^2$ during 30 s, 40 kg/cm$^2$ during 2.5 min and no pressure during The IB value was 970 kPa, TSW 29.1% and ABS (24 h) was 98.2%.

The invention claimed is:

1. An adhesive composition comprising at least partly gelatinised native starch and one or more polymers (P) containing a primary amine group, wherein the amount of starch in the adhesive composition is from about 15 to about 40 weight %, which adhesive composition further comprises a polymer containing acetoacetoxy groups.

2. The adhesive composition according to claim 1, wherein the at least partly gelatinised starch is obtained by subjecting an aqueous mixture comprising a native starch to an elevated temperature of from about 50 to about 99° C.

3. The adhesive composition according to claim 2, wherein the at least partly gelatinised native starch is obtained by maintaining the aqueous mixture comprising starch to the elevated temperature for at least 1 minute.

4. The adhesive composition according to claim 1, wherein the amount of one or more polymers (P) in the adhesive composition is from about 2 to about 25 weight %.

5. The adhesive composition according to claim 1, wherein the amount of the sum of starch and the one or more polymers (P) in the adhesive composition is from about 35 to about 55 weight %.

6. The adhesive composition according to claim 1, wherein the one or more polymers (P) is selected from the group consisting of polyvinyl amine, poly(vinylalcohol-co-vinyl amine), and polyallylamine.

7. The adhesive composition according to claim 1, wherein the one or more polymer (P) is polyvinyl amine.

8. The adhesive composition according to claim 1, further comprises a polymer or copolymer of one or more ethylenically unsaturated monomers.

9. The adhesive composition according to claim 1, further comprises a cross-linker.

10. A combination of: an adhesive composition according to claim 1, and, a further adhesive composition comprising a dispersion of a polymer or copolymer of one or more ethylenically unsaturated monomers, which does not contain any amine or amide groups.

11. The combination according to claim 10, wherein the amount of starch based adhesive composition is from about 25 to about 75 weight %, based on the total of wet adhesive.

12. A method of manufacturing an adhesive composition comprising mixing a native starch and one or more polymers (P) containing a primary amine group in an aqueous phase at an elevated temperature to at least partly gelatinise the starch, wherein the amount of starch in the adhesive composition is from about 15 to about 40 weight % and wherein the adhesive composition further comprises a polymer containing acetoacetoxy groups.

13. The method according to claim 12, wherein the elevated temperature is from about 50 to about 99° C.

14. The method according to claim 12, wherein the elevated temperature is maintained for at least 1 minute.

15. The method according to claim 12, wherein the amount of one or more polymers (P) is from about 2 to about 25 weight %.

16. The method according to claim 12, wherein the one or more polymers (P) is selected from the group consisting of polyvinyl amine, poly(vinylalcohol-co-vinyl amine), and polyallylamine.

17. A method of gluing pieces of wood based materials comprising applying an adhesive composition comprising at least partly gelatinised native starch and one or more polymers (P) containing a primary amine group wherein the amount of starch in the adhesive composition is from about 15 to about 40 weight %, and which adhesive composition further comprises a polymer containing acetoacetoxy groups, onto one or more pieces of a wood based material, and joining the one or more pieces with one or more further pieces of a material, wherein the wood based materials are selected from solid wood, fiber-, chip-, and particleboard materials.

18. The method according to claim 17, comprising applying the adhesive composition onto a piece of wood based material, contacting the surface with applied adhesive composition with a surface of another piece of wood based material, thereby joining the pieces through the formation of an adhesive joint between the pieces.

19. The method according to claim 17, comprising the joining of more than two pieces of wood based materials.

20. The method according to claim 17, comprising gluing pieces of wood based materials wherein the pieces of wood based material are wood chips.

21. A wood based product comprising pieces of wood based material joined with an adhesive composition comprising at least partly gelatinised native starch and one or more polymers (P) containing a primary amine group wherein the amount of starch in the adhesive composition is from about 15 to about 40 weight %, and which adhesive composition further comprises a polymer containing acetoacetoxy groups, wherein the wood based materials are selected from solid wood, fiber-, chip-, and particleboard materials.

22. The wood based product according to claim 21, further comprises one or more layers, joined with one or more adhesive joints comprising starch and one or more polymers (P) containing an amine group.

23. The wood based product according to claim 21, further comprises wood based chips joined with an adhesive composition comprising starch and one or more polymers (P) containing an amine group.

* * * * *